US006488092B1

(12) United States Patent
Schoeffler

(10) Patent No.: US 6,488,092 B1
(45) Date of Patent: Dec. 3, 2002

(54) BY-PASS VALVE

(76) Inventor: William N. Schoeffler, 214 Carmel Dr., Lafayette, LA (US) 70501

( * ) Notice: Subject to any disclaimer, the term of this patent is extended or adjusted under 35 U.S.C. 154(b) by 0 days.

(21) Appl. No.: 09/974,239

(22) Filed: Oct. 9, 2001

(51) Int. Cl.[7] ..... E21B 34/08
(52) U.S. Cl. ..... 166/320; 166/332.1; 175/317
(58) Field of Search ..... 166/373, 320, 166/321, 332.1, 386; 175/317

(56) References Cited

U.S. PATENT DOCUMENTS 3,907,046 A * 9/1975 Gaylord ..... 137/10
5,609,178 A * 3/1997 Henning et al. ..... 137/10
6,167,969 B1 * 1/2001 Schoeffler ..... 166/320
6,293,341 B1 * 9/2001 McGarian et al. ..... 166/317

* cited by examiner

*Primary Examiner*—David Bagnell
*Assistant Examiner*—Jennifer R. Dougherty
(74) *Attorney, Agent, or Firm*—John D. Jeter

(57) ABSTRACT

The by-pass valve has a selective control already available to control the movement of a piston which is part of the main stream by-pass valve which diverts fluid from the pipe string bore to ports in the outer wall for projection of the fluid stream into a well.

8 Claims, 1 Drawing Sheet

BY-PASS VALVE

This invention pertains to flow control valves used down hole on drill strings to exercise down hole main stream valve control from the surface. More specifically, it pertains to valves controlled by manipulation of the flow rate of fluid pumped down the drill string bore.

RELATED PATENTS

Apparatus of U.S. Pat. No. 6,167,969 is preferred for used in the preferred embodiment of this invention. U.S. Pat. 6,167,969 is, by reference herein, made part of this application.

BACKGROUND OF THE INVENTION

During the drilling, completion work, and servicing of wells it is necessary to use the flow of fluid moving down the drill string bore to accomplish tasks outside the drill string. Washing down the casing inside walls before conducting some planned activities is an example. The washing down process requires the full flow of the available fluid stream.

In the past, several devices made possible the control of the down hole valves by actions carried out at the surface. Balls, darts, and spears were dropped down the drill string bore. Very often the drill string had to be tripped to make further changes in the down hole assembly to convert back to the usual drilling activity.

SUMMARY OF THE INVENTION

In a housing arranged to serve as a length element of the drill string a selector control valve is situated with a controlling element to be moved to the extent of it's limited travel by entrainment with the moving fluid in the drill string bore. The valve entrained element is the poppet situated to cooperate with an orifice in the flow path. In the preferred embodiment, on alternate downward excursions of the poppet, the poppet is allowed to move down to engage the orifice, and to move a selected distance with the orifice. On other downward excursions, the poppet is stopped well above the orifice, and the flow is not significantly impeded.

The orifice is carried by a piston that actuates a by-pass valve. The closed orifice creates enough differential pressure to move the piston until the piston opens enough by-pass area to accommodate the flow in the drill string bore. In the preferred embodiment, the piston is the movable element of a valve that opens to direct the fluid flow in the drill string bore through openings in the housing wall.

When fluid flow down the drill string bore is reduced below a selected amount, a spring urges the piston to close the by-pass valve. A spring in the selector valve urges the entrained poppet to return to the starting, and open, position. On the return trip, the selector valve actuator carrying the entrained element actuates a walk-around turret, well known in the art, to pre-set the actuator for a limited downward trek on the next onset of fluid flow which does not operate the by-pass valve.

While the by-pass valve is not actuated, fluid flow in the drill string bore proceeds down the flow channel as if no by-pass valve existed. A subsequent cessation of fluid flow presets the actuator walk-around to actuate the by-pass valve on the subsequent onset of fluid flow.

Each start and stop cycle of fluid flow actuates the walk-around to change the fluid flow path that follows the next onset of fluid flow.

The selector valve described above is a preferred embodiment because it exists in proven and reliable form. The by-pass valve will respond to any selector valve capable of occluding the fluid flow through the described orifice. It will respond to an object dropped down the drill string bore to occlude the orifice. Recovery of the object by wire line is an activity used in the past.

These and other objects, advantages, and features of this invention will be apparent to those skilled in the art from a consideration of this specification, including the attached claims and appended drawings.

BRIEF DESCRIPTION OF DRAWINGS

In the drawings, like captions refer to similar features.

DETAILED DESCRIPTION OF DRAWINGS

Figure 2:
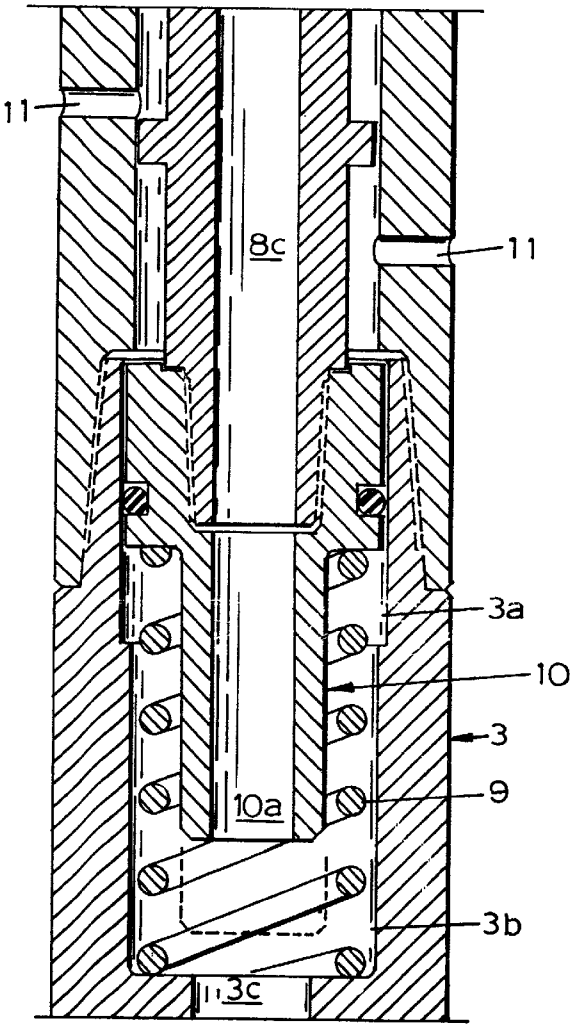
FIG. 2 is a side view, mostly cut away, of the lower end of the preferred embodiment of the invention before activation.
Figure 1:
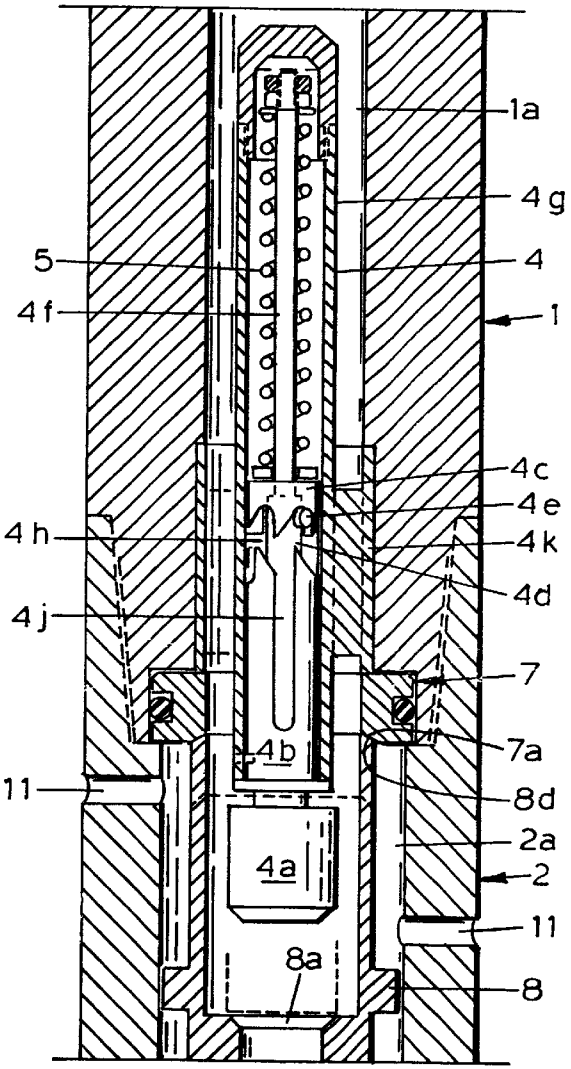
FIG. 1 is a side view, mostly cut away, of the top end of the preferred embodiment of the invention before activation.

FIG. 1 shows housing element 1 joined by housing element 2 which is, in turn joined by housing element 3 to complete the housing. Housing elements 1 and 3 have means (not shown) for attachment to continuing drill string components. Valve seat 7 cooperates with valve element 8, at seat 7*a*, to form a main stream by-pass valve to control fluid by-pass to annular passage, or plenum, 2*a*. Ports 11 represent an array of holes arranged to wash down casing, and accomplish other tasks, during well completion.

The opening in the housing that contains the working components comprises bores 1*a*, 2*a*, 3*a*, and 3*b*. The selective control valve comprises a selector means in housing 4*g* and principal selective control valve elements 4*a* and orifice 8*a*. The main fluid stream control valve comprises poppet face 8*d* and orifice seat 7*a*. After assembly, the piston comprises elements 10 and 8. In the absence of the selector valve shown, an object can be dropped down the drill string bore to occlude the orifice 8*a* with the same consequence as dropping poppet 4*a* onto the orifice.

Selective control valve selector means in housing 4 is the preferred actuator for the apparatus. It is patented, proven, and available. Housing 4*g* is secured in the bore 1*a* by sleeve 4*k* to which it is attached by radial fins. Poppet 4*a* makes a downward excursion each time flow down the drill string is started. On alternate excursions it moves only part way to orifice 8*a* and has no effect of the fluid path down the bore. On other excursions the poppet moves to occlude orifice 8*a*, and moves on down with the valve element 8.

When poppet 4*a* moves to close orifice 8*a*, flow through bore 8*c* is stopped and pressure builds above piston 10 and overcomes spring 9 to move the piston and valve element 8 downward. That movement opens the main stream by-pass valve comprising seat 7*a* and poppet 8*d*, admitting the down flowing fluid to annular opening 2*a*.

When the main stream flow is reduced below a preselected amount, poppet 4*a* is moved upward by spring 5 allowing flow through bores 8*a*, 10*a* and 3*c*, and valve member 8 moves upward as urged by spring 9, closing the 7*a* and 8*d* opening.

The preferred selector means, which already exists, has housing 4*g* mounted in the bore 1*a*. Poppet 4*a*, in it's most upward position, exposes its upper surface to fluid impact due to fluid flow down the drill string bore. Spring 5 is sized such that a preselected flow down the drill string bore will move the poppet downward. Cam follower 4*e* is affixed to shaft 4*d* and rides within the confines of the serpentine groove containing regions 4*h*, and 4*j*, which are cut in blocks 4*b* and 4*c*.

The cam follower, or pin, 4*e* moves up to the travel limit when there is no fluid flow and moves down to the travel limit when a selected flow exists in the drill string bore. The up and down cycles walks the pin 4*c*, around the turret, in an endless procession. This is the well known walk-around system used for years by those skilled in the art of down hole machine design and construction.

From the foregoing, it will be seen that this invention is one well adapted to attain all of the ends and objects hereinabove set forth, together with other advantages which are obvious and which are inherent to the tool.

It will be understood that certain features and sub-combinations are of utility and may be employed without reference to other features and sub-combinations. This is contemplated by and is within the scope of the claims.

As many possible embodiments may be made of the apparatus of this invention without departing from the scope thereof, it is to be understood that all matter herein set forth or shown in the accompanying drawings is to be interpreted as illustrative and not in a limiting sense.

I claim:

1. A by-pass valve for controlling the path of a fluid stream moving down a bore in a drill string suspended in a well, the by-pass valve comprising:

a) a housing arranged to function as a length element of drill string, with a generally central opening which conducts the fluid stream;

b) a selector means in said opening to control a selective control valve in response to manipulation of fluid flow rate down the drill string bore;

c) said selective control valve comprising a poppet manipulated by said selector means arranged to cooperate with an orifice which conducts said fluid stream;

d) a piston, with an orifice, sealingly situated in said opening, arranged to carry said orifice and move in response to pressure differential created by said selective control valve;

e) a main stream by-pass valve in said opening, responsive to movement of said piston to change between open and closed states;

f) a channel to conduct said fluid stream from said main stream by-pass valve to a plenum, said plenum formed by an outer surface of said piston an a wall of said opening;

g) a spring to urge said piston to move to close said main stream by-pass valve; and h) ports in fluid communication with said plenum to direct the fluid stream from said housing into the well.

2. The by-pass valve according to claim 1 wherein said main stream by-pass valve comprises two principal elements, a poppet on the piston and an orifice in said opening.

3. The by-pass valve according to claim 1 wherein said piston is tubular, the main fluid stream flowing through the piston bore when the apparatus is not activated.

4. The by-pass valve according to claim 1 wherein the main fluid stream flows through the bore of the piston, which is tubular, when the apparatus is not activated and flows down the outer surface of the piston when the apparatus is activated.

5. A by-pass valve for controlling the path of a fluid stream moving down a bore in a drill string suspended in a well, the by-pass valve comprising:

a) a housing arranged to function as a length element of drill string, with a generally central opening which conducts the fluid stream;

b) a selective control valve in said opening to control the fluid stream in response to manipulation of rate of the fluid flow down the drill string bore;

c) a tubular piston sealingly situated, in said opening and arranged to conduct the fluid stream through a piston bore and to move in response to pressure differential created by said selective control valve;

d) a main stream by-pass valve in said opening, responsive to movement of said piston to change between open and closed states;

e) a channel to conduct the fluid stream from said main stream by-pass valve to a plenum, said plenum formed by an outer surface of said piston and a wall of said opening;

f) a spring to urge said piston to move to close said main stream by-pass valve; and g) ports in fluid communication with said plenum to direct the fluid stream from said housing into the well.

6. A by-pass valve according to claim 5, wherein said main stream by-pass valve comprises a tubular poppet on said piston and a cooperating by-pass orifice on said housing.

7. A by-pass valve according to claim 5, wherein said selective control valve is comprised of a poppet which cooperates with an orifice, on said tubular piston, which admits the fluid stream to the bore of said tubular piston.

8. A by-pass valve for controlling the path of a fluid stream moving down a bore in a drill string suspended in a well, the by-pass valve comprising:

a) a housing arranged to function as a length element of drill string, with a generally central opening which conducts the fluid stream;

b) a selector means in said opening to control a selective control valve in response to manipulation of fluid flow rate down the drill string bore;

c) said selective control valve comprising a poppet manipulated by said selector means arranged to cooperate with an orifice which conducts said fluid stream;

d) a piston, with an orifice, sealingly situated in said opening, arranged to carry said orifice and move in response to pressure differential created by said selective control valve;

e) a main stream by-pass valve in said opening, responsive to movement of said piston to change between open and closed states;

f) a channel to conduct said fluid stream from said main stream by-pass valve to a plenum, said plenum formed by an outer surface of said piston and a wall of said opening;

g) a spring to urge said piston to move to close said main stream by-pass valve;

h) ports in fluid communication with said plenum to direct the fluid stream from said housing into the well; and i) said selector means comprising a valve that responds to manipulations of the flow rate of the fluid moving down the bore of the drill string to actuate said main stream control valve when said manipulations correspond to a preselected characteristic.

* * * * *